United States Patent [19]

Utz et al.

[11] 4,137,688

[45] Feb. 6, 1979

[54] METHOD OF VACUUM PACKING OBJECTS IN PLASTIC FOIL

[75] Inventors: Kastulus Utz, Neubeuern; Josef Esterhammer; Heinz Häkl, both of Rosenheim, all of Germany

[73] Assignee: Alkor-Werk Karl Lissmann GmbH & Co KG, Munich, Fed. Rep. of Germany

[21] Appl. No.: 826,385

[22] Filed: Aug. 22, 1977

[30] Foreign Application Priority Data

Sep. 13, 1976 [DE] Fed. Rep. of Germany ..... 2641160

[51] Int. Cl.[2] ..... B65B 31/02

[52] U.S. Cl. ..... 53/432; 53/433; 53/86; 53/511

[58] Field of Search ..... 53/22 A, 86, 112 A, 53/22 R, 112 R

[56] References Cited

U.S. PATENT DOCUMENTS

| | | | |
|---|---|---|---|
| 3,673,760 | 7/1972 | Canamero et al. | 53/22 A |
| 3,956,867 | 5/1976 | Utz et al. | 53/22 A |

*Primary Examiner*—Travis S. McGehee
*Attorney, Agent, or Firm*—Hans Berman

[57] ABSTRACT

Objects are packed in respective receptacles in a unitary body of sheet material having orifices open in a common direction. An annular edge portion of the body envelops the orifices and one or more rib portions of the body separate each orifice from each other orifice. A cover of sheet material is superimposed in a vacuum chamber on the edge portion and the orifices and sealed gastight to the edge portion. When the body with the sealed cover is exposed to atmospheric pressure, the cover is pressed by the air against the rib portions and may be sealed thereto. The sealing die employed in this process need only clamp the edge portion of the sheet material body against a suitable backing die.

8 Claims, 1 Drawing Figure

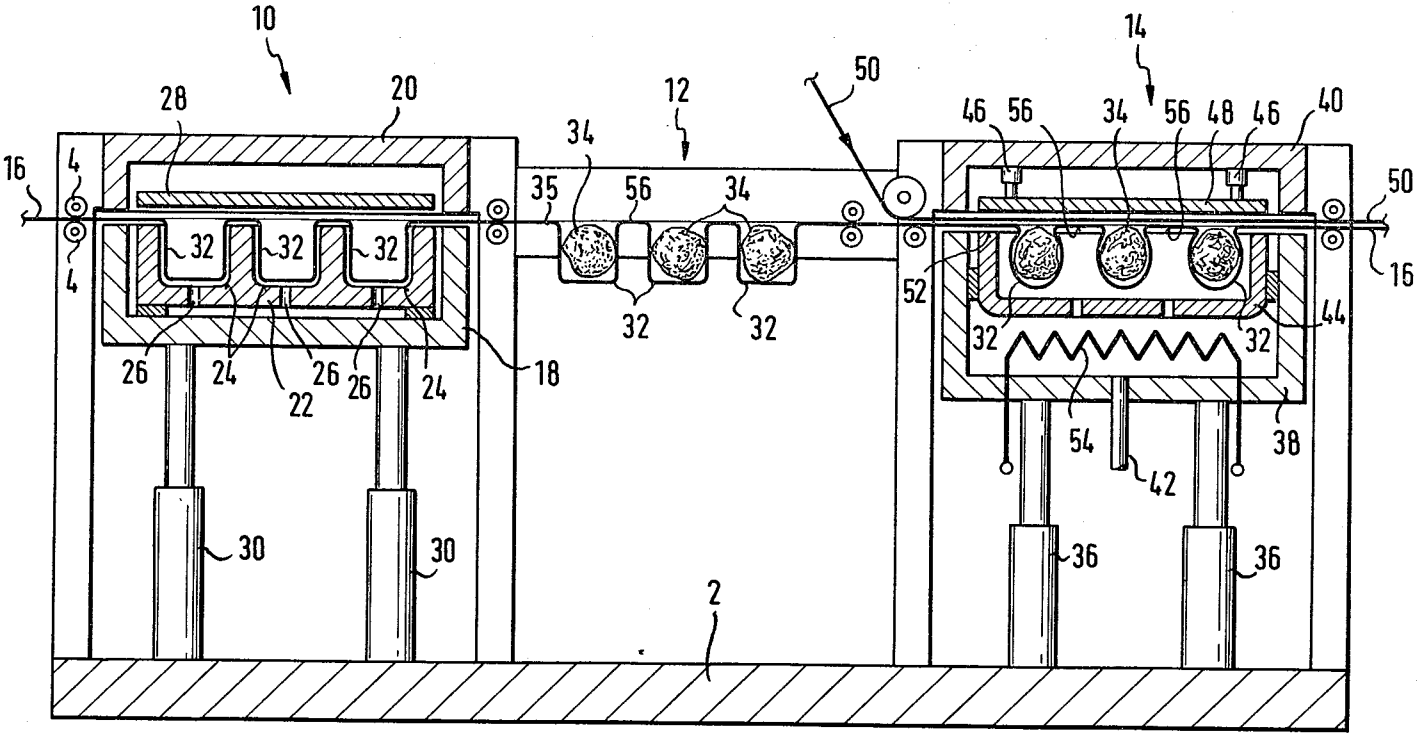
50
16
40
46
48
56
14
34
56
46
44
32
38
36
42
54
36
32
52
50
32
34
12
56
32
34
35
2
18
20
10
28
24
26
32
26
22
24
32
26
30
30
4
4
16

METHOD OF VACUUM PACKING OBJECTS IN PLASTIC FOIL

This invention relates to the vacuum packaging of objects in plastic foil, and particularly to a method of packing several objects in respective receptacles of a unitary sheet sealed by a common cover sheet and evacuated, and to apparatus for sealing the objects in the receptacles.

It is known, for example, from the published German patent application No. 2,364,565, to form receptacles in a sheet of thermoplastic synthetic resin composition by vacuum molding in such a manner that the receptacles are open in a common direction and are separated from each other by ribs of the sheet material. The material to be packed is inserted in the receptacles, and the orifices are sealed by a common cover sheet which may be heat sealed or otherwise fastened to the ribs under the pressure of a sealing die.

The sealing die in the known packing arrangement must conform to the several ribs and is suitable only for sealing receptacles whose orifices have the same dimensions and are arranged in the same manner in each sheet. This is acceptable in long runs, but may greatly increase the cost of the packing operation if deep-drawn sheets carrying objects differing in size and configuration have to be sealed in quick succession.

It is a primary object of this invention to provide a packing method and equipment for performing the method which is capable of interchangeably sealing packages of the type described which vary in size and distribution of receptacles in a shaped body of sheet material.

With this object and others in view, the invention, in one of its aspects provides a method in which respective objects to be packed are inserted in receptacles formed in a unitary body of sheet material and having orifices open in a common direction. An annular edge portion of the body envelops the orifices, and at least one rib portion of the body separates each orifice from each other orifice. The body with the inserted objects is held at subatmospheric pressure in a chamber in which a cover sheet is superimposed on the edge portion and the receptacle orifices. The cover sheet is sealed to the edge portion, and the body and cover sheet thereafter are exposed to a sufficiently higher gas pressure to cause the cover sheet to be pressed against the rib portions, whereupon the cover sheet is sealed to the rib portions.

The apparatus for performing the method includes the necessary forming equipment for forming the receptacles in a unitary body of sheet material, and sealing equipment including a chamber whose cavity may be closed and evacuated. A first sealing tool in the cavity is formed with a recess dimensioned to receive the receptacles of the body to be sealed in a position in which the recess is open in the common open direction of the receptacle orifices. A rim portion of the first tool bounds the recess and backs the edge portion of the sheet material body. One of the tools may be moved relative to the other tool toward and away from clamping engagement of the edge portion between the rim portion and the second tool so that a cover sheet placed on the sheet material body may be sealed to the edge portion.

Other features, additional objects, and many of the attendant advantages of this invention will readily be appreciated as the same becomes better understood by reference to the following detailed description of a preferred embodiment when considered in connection with the appended drawing whose sole FIGURE shows continuous packaging equipment of the invention in sectional side elevation, only as much of the equipment being shown as is necessary for an understanding of the invention.

The illustrated apparatus consists of a deep drawing station 10, a charging station 12, and a sealing station 14 which are mounted on a common support structure 2. A foil or sheet 16 of thermoplastic, synthetic resin composition is moved stepwise, sequentially through the three stations by driven pinch rollers 4.

The deep drawing station 10 includes a lower platen 18 mounted on hydraulic jacks 30, and a fixed upper platen 20. The lower platen 18 carries a deep-drawing die 22, a rectangular block of cast polyester resin formed with three rows of upwardly open recesses 24, only one recess of each row being seen in the drawing. A heating plate 28 is horizontally mounted above the orifices of the recesses 24. Bores 26 in the bottom wall of each recess 24 are connected alternatively to a suction line and to a compressed air line by valves, not shown and conventional in themselves.

The initially flat foil or sheet 16 is drawn into the space between the heating plate 28 and the die 22, moved close to the heating plate 28 by air blown into the recesses 24 through the bores 26. Vacuum thereafter established in the recesses 24 causes the heat-softened sheet 16 to be drawn into the recesses.

When the platen 18 is lowered, the roller 4 moves the formed sheet section into the charging station 12 and draws a new flat section of sheet material into the deep-drawing station 10. The drawn sheet has three rows of upwardly open receptacles 32 corresponding to the recesses 24 in the die 22. The objects 34 to be packed are inserted into the receptacles 32 manually or by non-illustrated dispensing equipment at the charging station 12. The several receptacles 32 are separated by integral ribs 56, and an edge portion 35 of the sheet 16, imperforate and free from recesses, envelops the orifices of the receptacles 32 and is gripped by pinch rolls 4 which move the charged, formed sheet 16 into the sealing station.

The sealing station 14 has a lower platen 38 mounted on hydraulic jacks 36 and a fixed upper platen 40. The platen 38 may be raised beyond the illustrated position into sealing engagement with the upper platen 40. The closed chamber cavity of the sealing station 14 formed thereby may be evacuated or charged with compressed air through a nipple 42 on the platen 38.

A lower sealing die 44 having the shape of a shallow, rectangular dish is fixedly mounted on the platen 38. Hydraulic jacks 46 on the upper platen 40 permit a flat, heated upper sealing die 48 to be raised and lowered in the closed sealing chamber relative to the rectangular upper rim 52 of the lower die 44.

Another foil or sheet 50 of thermoplastic, synthetic resin composition is drawn into the sealing chamber in superimposed relationship to the sheet 16. The width of the sheet 50, hereinafter referred to as the cover sheet, is identical with that of the sheet 16 so that the cover sheet 50 is superimposed on the imperforate edge portion 35 of the formed sheet 16 on all four sides of the receptacles 32.

During the movement of the charged sheet 16 and the cover sheet 50 into the sealing chamber, the lower platen 38 is lowered to clear the receptacles 32, and the recess in the lower die 44 is dimensioned to receive all receptacles. When the sealing chamber is sealed and evacuated through the nipple 42, the receptacles also are evacuated. When the heated upper sealing die 48 is lowered by the jacks 46 until it engages the edge portion 35 while the edge portion is backed by the rectangular rim 52 of the lower die, the cover sheet 50 is heat sealed to the edge portion 35 while the portion of the cover sheet 50 overlying the orifices of the receptacles 32 and the ribs 56 is still free.

When air under atmospheric or higher pressure is admitted to the sealing chamber, the cover sheet 50 and the sheet material of the ribs 56 are firmly pressed by the air against each other, and the cover sheet is heat sealed to the ribs by the upper sealing die 48. The temperature in the sealing chamber may be controlled by a heating coil 54 in such a manner that the resin material of the sheet 16 shrinks about the packed objects 34, the temperature variation in the chamber being preferably controlled in such a manner that the shrinkage occurs prior to sealing of the cover sheet 50 to the edge portion 35, preferably during evacuation of the chamber.

After completion of the sealing operation, the platen 38 is lowered to permit the sheet 16 including the sealed receptacles 32 to be withdrawn while a new group of receptacles enters the sealing station 14. If so desired, the withdrawn sealed sheet 16 may be cut through the ribs 56 to form individual packed containers.

A conveyorized packing arrangement has been illustrated and described above, but the sealing chamber of the invention may be employed for closing groups of receptacles formed in sheet material in any manner other than as specifically described. The sealing station 14 can handle receptacles of any size and distribution that fit into the recess of the lower sealing die 44 without requiring adjustment or replacement of the die 44. It may also be employed for sealing empty receptacles which are later to be charged by means of hollow needles if a cover sheet 50 of self-sealing, elastomeric material is employed.

Reference has been had above to heat sealing of the cover sheet 50 to the several parts of the sheet 16, and nylon foils coated with polyethylene are preferred for this purpose. However, pressure-sensitive adhesives not requiring thermal activation may be employed in an obvious manner. Other variations will readily suggest themselves to those skilled in the art.

It should be understood, therefore, that the foregoing disclosure relates only to a preferred embodiment of the invention, and that it is intended to cover all changes and modifications of the example of the invention herein chosen for the purpose of the disclosure which do not constitute departures from the spirit and scope of the invention set forth in the appended claims.

What is claimed is:

1. A method of packing objects which comprises:

(a) inserting respective ones of said objects in receptacles formed in a unitary body of sheet material,
  (1) said receptacles having orifices open in a common direction,
  (2) said body having an annular edge portion enveloping said orifices and at least one rib portion separating each orifice from each other orifice;

(b) holding said body having said objects inserted therein in a closed chamber while a first gas pressure lower than atmospheric pressure is maintained in said chamber;

(c) superimposing a cover member of sheet material on said edge portion and said orifices in said chamber;

(d) sealing said cover member to said edge portion in gastight engagement;

(e) exposing said body and the cover member sealed to said edge portion to a second gas pressure sufficiently higher than said first pressure to cause said cover member to be pressed against said at least one rib portion; and (f) thereafter sealing said cover member in gastight engagement to said at least one rib portion.

2. A method as set forth in claim 1, wherein said second pressure is at least equal to atmospheric pressure.

3. A method as set forth in claim 2, wherein said edge portion has a substantially planar surface directed in said common direction, said cover member having a substantially planar face being sealed to said surface.

4. A method as set forth in claim 3, wherein at least the portion of said face being sealed to said edge portion includes a thermally activated adhesive material and is heated prior to said sealing to a temperature sufficient for sealing said cover member to said edge portion.

5. A method of packing objects which comprises:

(a) inserting respective ones of said objects in receptacles formed in a unitary body of sheet material,
  (1) said receptacles having orifices open in a common direction,
  (2) said body having an annular edge portion enveloping said orifices and rib portions respectively separating each orifice from each other orifice;

(b) holding said body having said objects inserted therein in a closed chamber while a first gas pressure lower than atmospheric pressure is maintained in said chamber;

(c) superimposing respective portions of a unitary cover member of sheet material on said edge portion, said rib portions, and said orifices in said chamber;

(d) sealing said edge portion to the superimposed portion of said cover member in gastight engagement while keeping said rib portions and said orifices free of the respective superimposed portions;

(e) exposing said body and the cover member sealed to said edge portion to a second gas pressure sufficiently higher than said first gas pressure to cause said cover member to be pressed against said rib portions; and (f) sealing said cover member in gastight engagement to said rib portions.

6. A method as set forth in claim 5, wherein said second pressure is higher than the pressure of the atmosphere surrounding said chamber.

7. A method as set forth in claim 5, wherein said body essentially consists of thermally shrinkable synthetic resin composition and is heated to a temperature effective to cause shrinking of said composition about said objects prior to said sealing of said cover member to said at least one rib portion.

8. A method as set forth in claim 6, wherein said sheet materials essentially consist of thermoplastic resin composition.

* * * * *